United States Patent [19]

Snyder et al.

[11] Patent Number: 4,923,579

[45] Date of Patent: May 8, 1990

[54] ELECTROCHEMICAL PROCESS FOR ZIRCONIUM ALLOY RECYCLING

[75] Inventors: Thomas S. Snyder, Oakmont; Richard A. Stoltz, Murrysville; David Zuckerbrod, Pittsburgh, all of Pa.

[73] Assignee: Westinghouse Electric Corp., Pittsburgh, Pa.

[21] Appl. No.: 242,573

[22] Filed: Sep. 12, 1988

[51] Int. Cl.[5] ..... C25F 5/00

[52] U.S. Cl. ..... 204/140

[58] Field of Search ..... 204/140

[56] References Cited

U.S. PATENT DOCUMENTS

| | | | |
|---|---|---|---|
| 2,214,211 | 9/1940 | Von Zeppelin | 75/84.5 |
| 2,905,613 | 9/1959 | Tomonari | 204/216 |
| 2,920,027 | 1/1960 | Dean | 204/218 |
| 2,942,969 | 6/1960 | Doyle | 75/84.5 |
| 3,764,493 | 10/1973 | Nicks | 205/64 R |
| 4,127,409 | 11/1978 | Megy | 75/84.5 |
| 4,285,724 | 8/1981 | Becker | 75/84.5 |
| 4,511,399 | 4/1985 | Kwon | 75/84.5 |
| 4,556,420 | 12/1985 | Evans | 75/84.5 |
| 4,613,366 | 9/1986 | Kwon | 75/84.5 |
| 4,637,831 | 1/1987 | Stoltz | 75/84.5 |
| 4,668,287 | 5/1987 | Kwon | 75/84.5 |
| 4,670,121 | 6/1987 | Ginatta | 204/225 |

OTHER PUBLICATIONS

Baker; "Electrorefining Zirconium", Bureau of Mines TN23-U7, No. 5758, 1961.

Martinez; Metall. Trans. 3,581, 1972.

Mellors; J. Electrochem Soc. 114,60, 1966.

*Primary Examiner*—T. M. Tufariello

*Attorney, Agent, or Firm*—R. A. Stoltz

[57] ABSTRACT

A major cost component for zirconium alloy manufacture and fabrication is metal scrap generation during fabrication. This scrap, which has already incurred the entire process conversion cost from zircon sand to metal refining, constitutes an expensive cost to the fabrication process. The present invention teaches that these alloy scraps may be separated into their components by molten salt electrolysis using FLINAK electrolyte. The alloy components are recycled directly to the alloying process as cathodic grade metals, saving the cost of completely repeating the zircon conversion process.

8 Claims, 1 Drawing Sheet

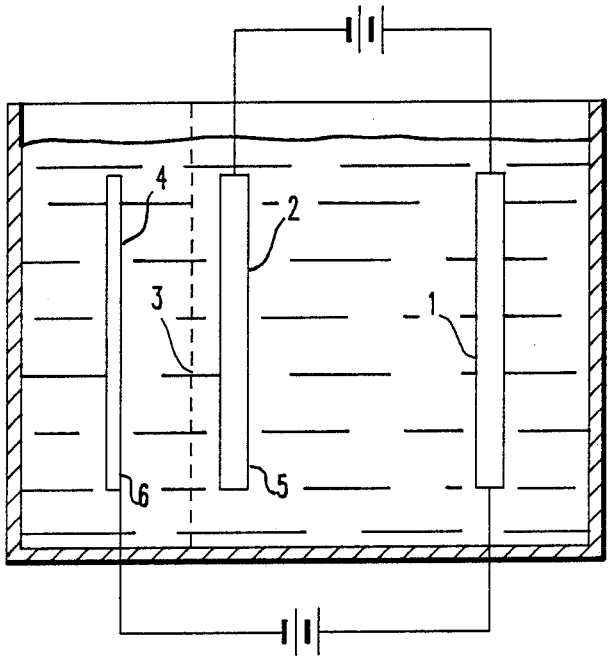
4
2
3
1
6
5

ELECTROCHEMICAL PROCESS FOR ZIRCONIUM ALLOY RECYCLING

CROSS REFERENCE TO CO-PENDING APPLICATIONS

A process for zirconium-hafnium separation is described in related application Ser. No. 242,574, filed Sept. 12, 1988 and assigned to the same assignee. That related application utilizes a complex of zirconium-hafnium chlorides and phosphorus oxychloride prepared from zirconium-hafnium chlorides with the complex of zirconium-hafnium chlorides and phosphorus oxychloride being introduced into a distillation column and a hafnium chloride enriched stream is taken from the top of the column and a zirconium enriched chloride stream is taken from the bottom of the column, and in particular with prepurifing said zirconium-hafnium chlorides prior to introduction of said complex into a distillation column to substantially eliminate iron chloride from the zirconium-hafnium chlorides, whereby buildup of iron chloride in the distillation column is substantially eliminated and the column can be operated in a continuous, stable manner.

An improved process for prepurification of zirconium-hafnium chlorides prior to preparation of a complex of zirconium-hafnium chlorides and phosphorus oxychloride for use in a distillation column for zirconium-hafnium separation is described in related application Ser. No. 242,572, filed Sept. 12, 1988 W. E. Case No. 541326) and assigned to the same assignee. That related application utilizes prepurification of zirconium-hafnium chlorides prior to complexing with phosphorus oxychloride by passing the zirconium-hafnium chloride through an essentially oxygen-free molten salt purification-sublimation system, and at least periodically removing iron chloride from the molten salt purification-sublimation system by electrochemically plating iron out of molten salt purification-sublimation system. The molten salt in the molten salt purification-sublimation system consisting essentially of a mixture of alkali metal and alkaline earth metal chlorides, zirconium-hafnium chlorides and impurities.

A process for zirconium-hafnium separation is described in related application Ser. No. 242,571, filed Sept. 12, 1988 and assigned to the same assignee. That related application utilizes a complex of zirconium and hafnium chlorides and phosphorus oxychloride introduced into a distillation column, with a hafnium chloride enriched stream of complex is taken from the top of the column and a zirconium enriched chloride stream of complex is taken from the bottom of the column, followed by reduction of the zirconium or hafnium chloride from complex taken from the distillation column by electrochemically plating zirconium or hafnium out of a molten salt bath with the molten salt in the molten salt bath consisting principally of a mixture of alkali metal and alkaline earth metal chlorides and zirconium or hafnium chloride.

A process for zirconium-hafnium separation is described in related application Ser. No. 242,570, filed Sept. 12, 1988 and assigned to the same assignee. That related application utilizes an extractive distillation column with a mixture of zirconium and hafnium tetrachlorides introduced into a distillation column and a molten salt solvent circulated through the column to provide a liquid phase, and with the molten salt solvent consisting principally of lithium chloride and at least one of sodium, magnesium and calcium chlorides. Stripping of the zirconium chloride taken from the bottom of distillation column is provided by electrochemically reducing zirconium from the molten salt solvent. A pressurized reflux condenser is used on the top of the column to add hafnium chloride to the previously stripped molten salt solvent which is being circulated back to the top of the column.

A process for zirconium-hafnium reduction (and possibly also separation) is described in related application Ser. No. 242,564, filed Sept. 12, 1988 and assigned to the same assignee. That related application utilizes reduction to metal of the zirconium and/or hafnium chloride taken from a distillation column by metallothermically-electrochemically reducing an alkaline earth metal in a molten salt bath with the molten salt in the molten salt bath consisting principally of a mixture of at least one alkali metal chloride and at least one alkaline earth metal chloride and zirconium or hafnium chloride, with the reduced alkaline earth metal reacting with the zirconium or hafnium chloride to produce zirconium or hafnium metal product and alkaline earth metal chloride.

A process for removing phosphorus oxychloride from a complex of zirconium or hafnium chloride and phosphorus oxychloride is described in related application Ser. No. 242,563, filed Sept. 12, 1988 and assigned to the same assignee. That related application utilizes a lithium-potassium chloride molten salt absorber vessel with a condenser which has the complex of zirconium or hafnium chloride and phosphorus oxychloride as the condensing fluid to scrub zirconium or hafnium chloride from the phosphorus oxychloride vapor. The process uses at least one separate vessel to strip the zirconium or hafnium chloride from the lithium-potassium chloride molten salt.

The preceding related applications are all assigned to the same assignee and are all hereby incorporated by reference.

BACKGROUND OF THE INVENTION

A major cost factor in the manufacture of nuclear grade zirconium and hafnium metals from zircon sand is the production of metal scrap during fabrication processing. This scrap has already incurred the entire production cost of converting zircon sand to metal ingot from the following operations: Chlorination, Purification (Iron Removal and Condensation), Separation, Precipitation, Rechlorination, Sublimation, Reduction, Distillation (for $MgCl_2$ and Mg removal), Double Arc Melting.

A significant manufacturing cost benefit could be realized if a process were available to separate zirconium metal from alloy scrap and to recycle it as metal without having to repeat all the manufacturing steps of the conversion process.

Modifications to the reduction process have been suggested in many U.S. Pat. Nos., including 4,511,399; 4,556,420; 4,613,366; 4,637,831; and 4,668,287, assigned to the same assignee.

Molten (fused) salt electrochemical (electrolytic) processes for deposition of metal on one electrode (with evolution of chlorine gas at the other electrode) are known in the art. U.S. Pat. Nos. 3,764,493 to Nicks et al. (utilizing a porous diaphragm), and 4,670,121 to Ginatta et al. are examples of such processes.

A high temperature process using zirconium tetrachloride as a part of a molten salt bath and reducing zirconium from the chloride to the metal (molten salt systems mentioned were potassium-zirconium chlorides and sodium-zirconium chlorides) is suggested in U.S. Pat. No. 2,214,211 to Von Zeppelin et al. A relatively high temperature process using zirconium tetrachloride as a part of a molten salt bath and introducing magnesium to reduce zirconium from the chloride to the metal (with external electrolytic reduction of magnesium from the chloride to the metal, to recycle magnesium) is suggested in U.S. Pat. No. 4,285,724 to Becker et al. Another high temperature process using zirconium tetrachloride as a part of a molten salt bath and which introduces sodium-magnesium alloy to reduce zirconium from the chloride to the metal (with a molten salt of magnesium chloride and sodium chloride is suggested in U.S. Pat. No. 2,942,969 to Doyle. Using zirconium tetrachloride as a part of a molten salt bath and preferably introducing aluminum (but possibly magnesium) to reduce zirconium from the chloride to the metal, generally with the aluminum being introduced dissolved in a molten zinc is taught by Megy in U.S. Pat. No. 4,127,409. Electrolytic-refining (metal in, metal out purification, rather than reduction from the chloride) processes are suggested in U.S. Pat. Nos. 2,905,613 and 2,920,027. (Note especially, "Electrorefining Zirconium," Baker et al., Bureau of Mines TN23-U7 No. 5758, 1961, on a sodium chloride-potassium fluorozirconate electrolyte.)

Direct electrolysis of zirconium has been reported in a all-chloride molten salt systems, in mixed chloride-fluoride systems, and in all fluoride systems (Martinez et al., Metallurgical Transactions, Vol. 3, Feb. 1972-571; Mellors et al, J of the Electrochemical Soc., Jan. 1966-60). All-metallic deposits were obtained from fluoride-containing baths (e.g. at 800° C. using sodium fluorozirconate), but the efforts to plate out of all-chloride baths always produced a significant amount of subchlorides.

SUMMARY OF THE INVENTION

This is a method of separating nickel from zirconium for recycling nickel-containing zirconium alloy, said method comprising: placing said nickel-containing zirconium in a molten salt bath consisting principally of a mixture of at least two alkali metal fluorides to produce a molten salt bath containing dissolved zirconium and dissolved nickel; electrochemically plating said nickel from said molten salt bath at a voltage sufficient to plate nickel but less than the voltage to plate zirconium to provide an essentially nickel-free molten salt bath; an electrochemically plating said zirconium from said essentially nickel-free molten salt bath to provide an essentially nickel-free zirconium. Preferably, the molten salt in said molten salt bath consists essentially of a mixture of lithium fluoride, sodium fluoride and potassium fluoride, with the lithium fluoride, sodium fluoride and potassium fluoride proportions being about 46.5 mole percent lithium fluoride, about 11.5 mole percent sodium fluoride and about 42 mole percent potassium fluoride, and the bath operated at 500°-700° C.

BRIEF DESCRIPTION OF THE DRAWINGS

The lone FIGURE is a schematic representation of a cell configuration.

DESCRIPTION OF THE PREFERRED EMBODIMENTS

The present invention teaches that zirconium alloys such as, Zircaloy-2, can be separated into their components by electrorefining. The electrolysis uses FLINAK electrolyte with the composition:

| Melting Point at 459° C. |
|---|
| LiF = 46.5 mole % |
| NaF = 11.5 mole % |
| KF = 42.0 mole % |

Alternately, 40 mole % NaF, 60 mole % KF melting at 722° C. could also serve as electrolyte.

FLINAK as the electrolyte for the alloy electrorefining is a significant improvement over chloride electrolytes on three counts:

First: One of the basic requirements of metal electrorefining is that the metal, in question, must be capable of anodic dissolution into the electrolyte. Zirconium metal cannot be anodically dissolved in molten chloride salts, with the current decomposing the molten salt bath with the evolution of chlorine; however, zirconium metal can readily be anodically dissolved in FLINAK.

Second: Zirconium won from $ZrCl_4$ solutions in molten chloride electrolytes yields a granular cathodic deposit which is difficult to collect. Zirconium can be won from FLINAK in a smooth continuous deposit which is easily recovered.

Third: The powdered zirconium deposits recovered from chloride electrolytes are pyrophoric on removal from the plating bath; smooth, continuous FLINAK deposits are not pyrophoric.

Table 1 defines the metal reduction series in FLINAK electrolyte, referenced to the nickel electrode, i.e., the Ni(II)/Ni(O) couple is defined as zero volts in the table $-E_{\chi}^{*}$(Ni),V. In the FLINAK reduction series, the zirconium reduction potential at −1.25 volts, relative to nickel, is sufficiently removed from the reduction potential of its alloying elements (nickel, iron, chromium, etc.) to allow their separation and recovery during electrolysis. More specifically, at reduction potentials below −1 v (use Ni(II/Ni(O) the alloying constituents are reduced at the first cathode, leaving zirconium in the electrolyte solution. At the reduction potential is increased to −1.3 or more volts, zirconium is recovered at the second cathode.

TABLE 1

FLINAK EMF SERIES[1]

| Couple | $E_{\chi}^{*}$(Ni),V | Precision, V |
|---|---|---|
| Li(I)/Li(0) | −2.14 | Cathodic limit: see text |
| Th(IV)/Th(0) | −2.131 | 0.01 |
| Ti(III)/Ti(0) | −1.798 | 0.005 |
| Ti(IV)/Ti(0) | −1.363 | Calculated |
| Zr(IV)/Zr(0) | −1.25 | Half-wave potential |
| Cr(III)/Cr(II) | −0.880 | Different melt |
| Cr(III)/Cr(0) | −0.747 | Calculated |
| Cr(II)/Cr(0) | −0.681 | Different melt |
| Fe(II)/Fe(0) | −0.390 | 0.01 |
| Fe(III)/Fe(0) | −0.327 | Calculated |
| Fe(III)/Fe(II) | −0.200 | 0.01 |
| Ni(II), sat./Ni(0) | −0.138 | Measured |
| Ti(IV)/Ti(III) | −0.058 | 0.005 |
| Ni(II)/Ni(0) | 0.000 | Defined |
| Pt quasi-reference | +0.15 | 0.05 |
| Pt(II)/Pt(0) | +1.65 | Anodic limit |

The zirconium separation reactor may be operated in both the batch and semi-continuous modes using the alloy as anode and recovering its components at the cathode(s). The following description addresses semi-continuous operations.

1. Encyclopedia of Electrochemistry, Volume X.

The anodic reactions, driving the alloy into the FLINAK solution, are as follows:

1. $Zr \rightarrow Zr(IV) + 4e^-$
2. $Ni \rightarrow Ni(II) + 2e^-$

The separation requires the use of a two cathode reactor design as shown in FIG. 1. Reactor electrode (1) is the Zr-Ni alloy scrap anode; electrode (2) is an extended surface Ni seed cathode such as fritted nickel or tight mesh nickel screen. The barrier, 3, is a nonconductive porous diaphragm made of material such as a nitride felt. Electrode (4) is the Zr seed cathode. Electrodes (5) and (6) are suitable reference electrodes.

The cell operating potential of the porous Ni electrode (2) is adjusted by varying $E_1$ to a value that is sufficiently negative to allow deposition of alloy scrap impurities such as iron and the nickel, but not sufficiently negative to allow the deposition of Zr. The Zr(IV) diffuses through the porous nickel frit or mesh 2, and through the porous diaphragm 3. This diaphragm 3 prevents mixing the nickel-free melt present in the zirconium cathodic compartment with the nickel pregnant melt of the anodic compartment. Finally, a Zr cathode 4 with a potential sufficiently negative for Zr deposition (below −1.25 volts) but above the potential for Li deposition (−2.14 volts), accumulates a sheet zirconium deposit, sufficiently pure for recycle. The potential on this cathode is adjusted by varying $E_2$ to control this deposition rate. Reference electrodes, such as Ni(II)/Ni(O) could be used at both cathodes to insure the accurate electrode potential control needed for a clean separation. $E_1$ and $E_2$ could be automatically adjusted by a potentiostatic circuit commonly found in constant voltage DC power supplies.

In designing the cell in FIG. 1 either planar electrodes, or extended surface electrodes could be employed in the reduction for zirconium recovery. Extended surface electrodes, as a semipermeable, electrochemical membrane are, however, very desirable for the nickel cathode. These increase the scrubbing efficiency for removing alloy contaminants from the zirconium in the electrolyte, and allow passage of Zr(IV). The advantages of the extended surface electrodes to increase scrubbing efficiency are: better mass transfer through shorter diffusion distances and induced cell turbulence; higher surface area per volume; more intimate electrode/electrolyte contact.

The present disclosure breaks zirconium-nickel alloys into their components. The components are recovered in high purity, electrochemically. Product purity is sufficient for direct recycle to fabrication. The cathodic deposits, contrary to chloride electrolysis products, are smooth and continuous.

The process permits recycle of zirconium and nickel from fabrication scrap to the fabrication process, directly eliminating the process costs that would have to be increased if the metals were being completely reprocessed. Thus it is the objective of the present invention to purify and recycle the metal directly without having to repeat the zircon conversion process.

This invention is not to be construed as limited to the particular examples described herein, as this is to be regarded illustrative, rather than restrictive. The invention is intended to cover all processes which do not depart from the spirit or the scope of the invention.

We claim:

1. A method of separating nickel from zirconium for recycling nickel-containing zirconium alloy, said method comprising:

a. placing said nickel-containing zirconium in a molten salt bath at 500° to about 722° C. with the molten salt in said molten salt bath consisting essentially of a mixture of 0 to about 46.5 mole % lithium fluoride, about 11.5 to about 40 mole % sodium fluoride and potassium fluoride to produce a molten salt bath containing dissolved zirconium and dissolved nickel;

b. electrochemically plating said nickel from said molten salt bath at a voltage sufficient to plate nickel but less than the voltage to plate zirconium to provide an essentially nickel-free molten salt bath; and c. electrochemically plating said zirconium from said essentially nickel-free molten salt bath to provide an essentially nickel-free zirconium.

2. The method of claim 1, wherein said lithium fluoride, sodium fluoride and potassium fluoride are present in near-eutetic proportions.

3. The method of claim 1, wherein said lithium fluoride, sodium fluoride and potassium fluoride proportions are about 46.5 mole percent lithium fluoride, about 11.5 mole percent sodium fluoride and about 42 mole percent potassium fluoride.

4. The method of claim 1, wherein said bath is operated at 500°–700° C.

5. The method of claim 1, wherein said electrochemically plating said nickel from said molten salt bath to provide an essentially nickel-free molten salt bath is performed prior to said electrochemically plating said zirconium from said essentially nickel-free molten salt bath.

6. The method of claim 1, wherein a nickel deposition electrode and a zirconium deposition electrode are placed in said molten salt bath with said nickel deposition electrode being located between said zirconium to be recycled and said zirconium deposition electrode to electrochemically plate said nickel from said molten salt bath to provide an essentially nickel-free molten salt bath adjacent to said zirconium deposition electrode to provide electrochemical plating of essentially nickel-free zirconium on said zirconium deposition electrode.

7. The method of claim 6, wherein a porous nickel deposition electrode is utilized and molten salt containing zirconium to be recycled passes through said porous electrode before reaching said zirconium deposition electrode, to electrochemically plate said nickel from said molten salt bath onto said porous electrode such that molten salt which has passed through said porous electrode is an essentially nickel-free molten salt which, when placed adjacent to said zirconium deposition electrode, provides for electrochemical plating of essentially nickel-free zirconium on said zirconium deposition electrode.

8. The method of claim 7, wherein a porous and a second nickel deposition electrodes are utilized with said second nickel deposition electrode being located closer to said zirconium to be recycled than said porous nickel deposition electrode.

* * * * *